US012629600B2

(12) United States Patent
Ward

(10) Patent No.: US 12,629,600 B2
(45) Date of Patent: May 19, 2026

(54) INFLATABLE ENTERTAINMENT STRUCTURES

(71) Applicant: Mega Entertainment, Inc., Chino Hills, CA (US)

(72) Inventor: Timothy Ward, Chino Hills, CA (US)

(73) Assignee: MEGA ENTERTAINMENT, INC., Chino Hills, CA (US)

( * ) Notice: Subject to any disclaimer, the term of this patent is extended or adjusted under 35 U.S.C. 154(b) by 641 days.

(21) Appl. No.: 18/054,646

(22) Filed: Nov. 11, 2022

(65) Prior Publication Data

US 2023/0166194 A1 Jun. 1, 2023

Related U.S. Application Data

(60) Provisional application No. 63/263,980, filed on Nov. 12, 2021.

(51) Int. Cl.
*A63G 31/00* (2006.01)

(52) U.S. Cl.
CPC ..... *A63G 31/00* (2013.01)

(58) Field of Classification Search
CPC ..... A63G 31/00
USPC ..... 472/137
See application file for complete search history.

(56) References Cited

U.S. PATENT DOCUMENTS

| | | | | |
|---|---|---|---|---|
| 8,752,336 | B1 * | 6/2014 | Ozsuer | E04H 9/028 52/2.18 |
| 9,624,688 | B1 * | 4/2017 | Tyson | E04H 15/06 |
| 2011/0059676 | A1 * | 3/2011 | Scherba | G09B 25/04 446/478 |
| 2011/0253184 | A1 * | 10/2011 | Mills | E04H 15/20 135/96 |
| 2015/0101258 | A1 * | 4/2015 | Milo | E04B 1/3408 52/2.18 |
| 2016/0201351 | A1 * | 7/2016 | Pirkle | E04H 15/20 135/121 |
| 2016/0243421 | A1 * | 8/2016 | Scherba | A63B 17/00 |

* cited by examiner

*Primary Examiner* — Michael G Lee
(74) *Attorney, Agent, or Firm* — Knobbe Martens Olson & Bear LLP

(57) ABSTRACT

An inflatable structure that includes a roof structure comprised of inflatable beams interlocked to form a hexagonal pattern. Inflatable columns support the roof structure. The inflatable columns can be selectively retracted to change the interior structure of the inflatable structure. Walls can be placed between the inflatable columns to further vary the interior structure and create mazes. The inflatable structure can be themed, e.g., by installing themed skins on interior surfaces of the room to provide a user experience. The inflatable structure may also include integrated virtual reality components, including a virtual reality headset supported by the structure.

10 Claims, 13 Drawing Sheets

INFLATABLE ENTERTAINMENT STRUCTURES

PRIORITY APPLICATION

This application claims priority to U.S. Provisional Application No. 63/263,980, filed Nov. 12, 2021, which is incorporated herein by reference. Any and all applications for which a foreign or domestic priority claim is identified in the Application Data Sheet as filed with the present application are hereby incorporated by reference under 37 CFR 1.57.

BACKGROUND

Field

This application generally relates to inflatable entertainment structures.

Description of Related Art

Various types of recreational play structures are available to entertain children and adults. Inflatable playhouses or inflatable bounce houses, for example, have become very popular in recent years. These inflatable structures provide entertainment for children and adults.

SUMMARY

Inflatable structures are described herein that include a roof structure comprising inflatable beams interlocked in a hexagonal pattern. An inflatable structure can include inflatable columns that support the roof structure. In some embodiments, the inflatable structure can include a base structure comprising inflatable beams that support the one or more inflatable columns. In some embodiments, the inflatable columns can be selectively retracted to generate different arrangements. In some embodiments, these different arrangements are mazes through the inflatable structure.

In some embodiments, the inflatable structure comprises a roof structure made of a plurality of inflatable beams forming a hexagonal pattern and one or more inflatable columns that support the roof structure. In some embodiments, the inflatable structure further comprises a base structure comprising inflatable beams that support the one or more inflatable columns. In some embodiments, the inflatable structure further comprises a ground structure comprising a layer between the inflatable columns and a ground. In some embodiments, the inflatable structure further comprises the inflatable columns are configured to be selectively retracted to generate different arrangements. In some embodiments, the inflatable structure further comprises tabs configured to accept a rope to prevent the inflatable structure from moving. In some embodiments, the inflatable structure further comprises an air inlet configured to receive air to inflate the inflatable structure. In some embodiments, the inflatable structure further comprises one or more walls configured to be connected between the inflatable columns, wherein the one or more walls can be removed when the inflatable columns are retracted. In some embodiments, the one or more walls are inflatable. In some embodiments, the inflatable structure further comprises one or more themed skins configured to be installed over the one or more walls to change how the one or more walls appear. In some embodiments, a first inflatable structure is configured to connect with a second inflatable structure to create a larger inflatable structure. In some embodiments, the inflatable structure comprises a roof structure comprising inflatable beams and inflatable columns that support the roof structure, wherein the inflatable columns are configured to be selectively retracted to generate different arrangements.

The inflatable structures described herein, as well as related devices, systems, and methods, have innovative aspects, no single one of which is indispensable or solely responsible for their desirable attributes. This summary addresses only certain features or aspects of the inflatable structures described in this application and should not be construed as limiting.

BRIEF DESCRIPTION OF THE DRAWINGS

The above-mentioned aspects, as well as other features, aspects, and advantages of the inflatable structures disclosed herein will now be described in connection with various embodiments and with reference to the accompanying drawings. The illustrated embodiments are merely examples and are not intended to be limiting. Like reference numbers and designations in the various drawings indicate like elements.

FIGS. 6A-6D illustrate an embodiment of the inflatable structure with dimensions for the example embodiment, wherein FIG. 6A is a top perspective view, FIG. 6B is a top view, FIG. 6C is a front view, and FIG. 6D is a side view;

FIG. 7A-7D illustrate an embodiment of four inflatable structures placed adjacently with dimensions for the example embodiment, wherein FIG. 6A is a top perspective view, FIG. 6B is a top view, FIG. 6C is a front view, and FIG. 6D is a side view;

FIGS. 8A-8D and 9A-9D illustrate embodiments of the inflatable structure with walls connected between the inflatable columns, wherein FIGS. 8A and 9A are top perspective views, FIGS. 9B and 10B are top views, FIGS. 9C and 10C are front views, and FIGS. 9D and 10D are side views.

DETAILED DESCRIPTION

Figure 1:
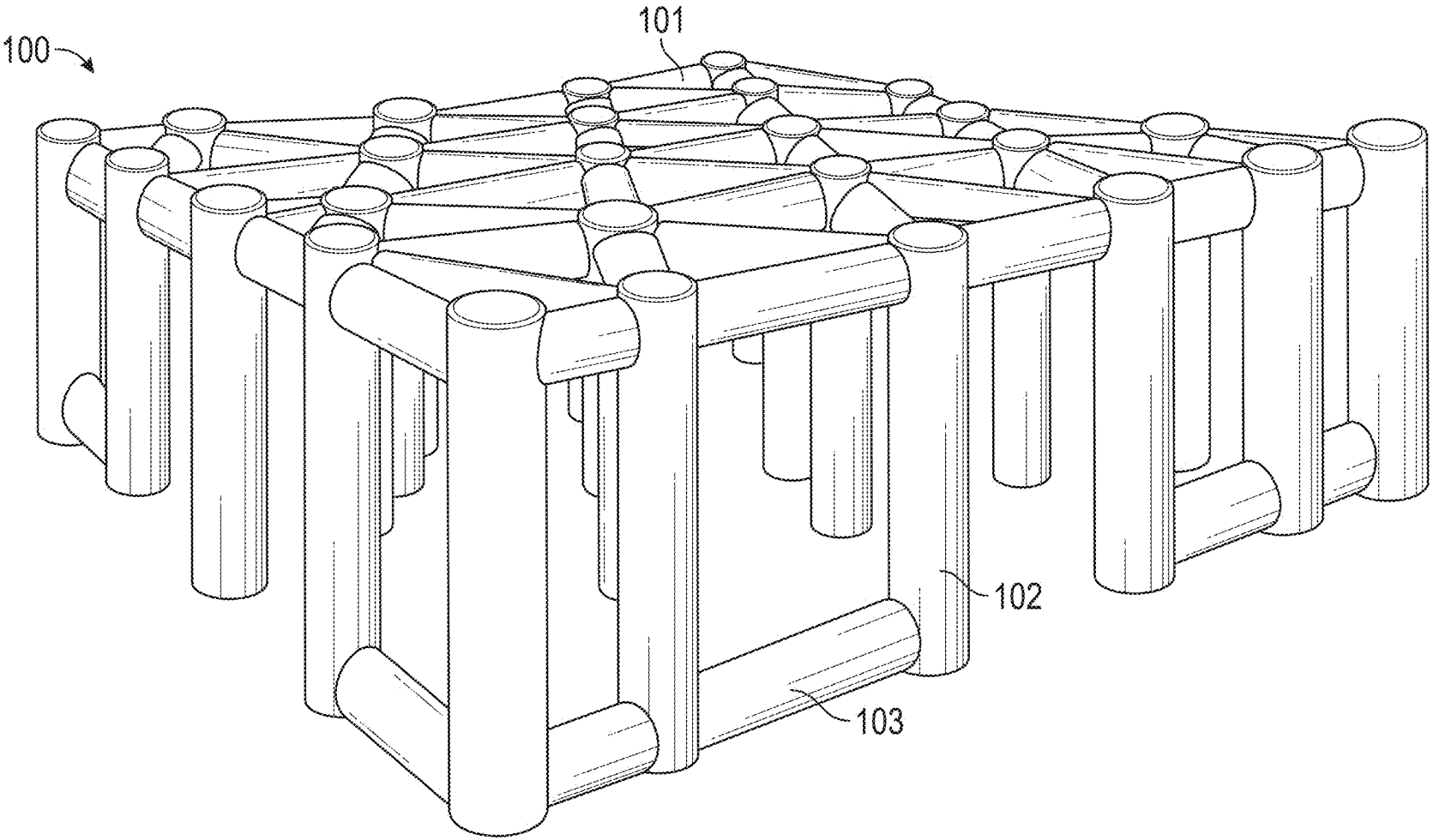
FIG. 1 illustrates an embodiment of an inflatable structure that includes a roof structure comprising inflatable beams forming triangular or hexagonal patterns that is supported by inflatable columns positioned at the vertices of the triangles or hexagons.
Figure 2:
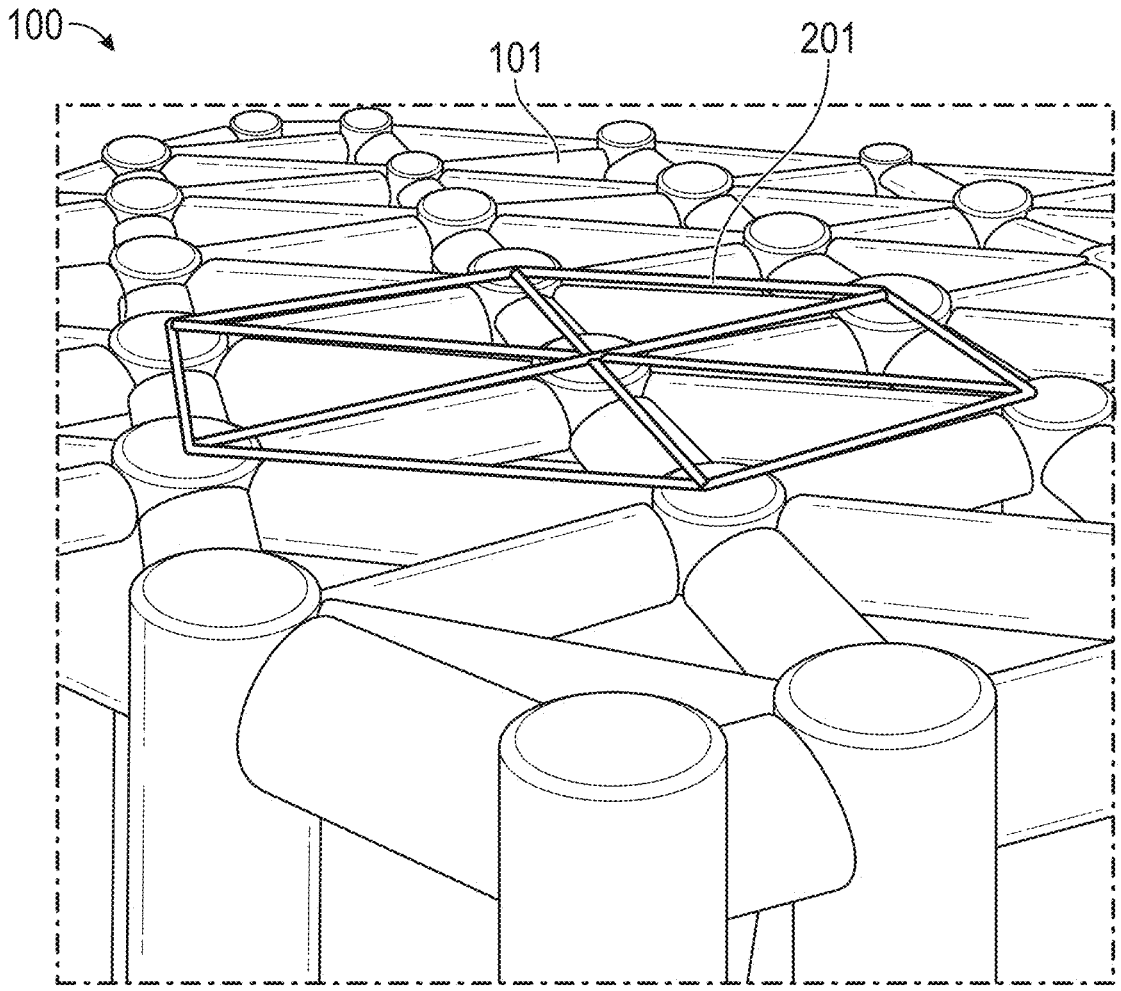
FIGS. 2 and 3 illustrate embodiments of the inflatable beams forming the patterns of the roof structure in greater detail.
Figure 3:
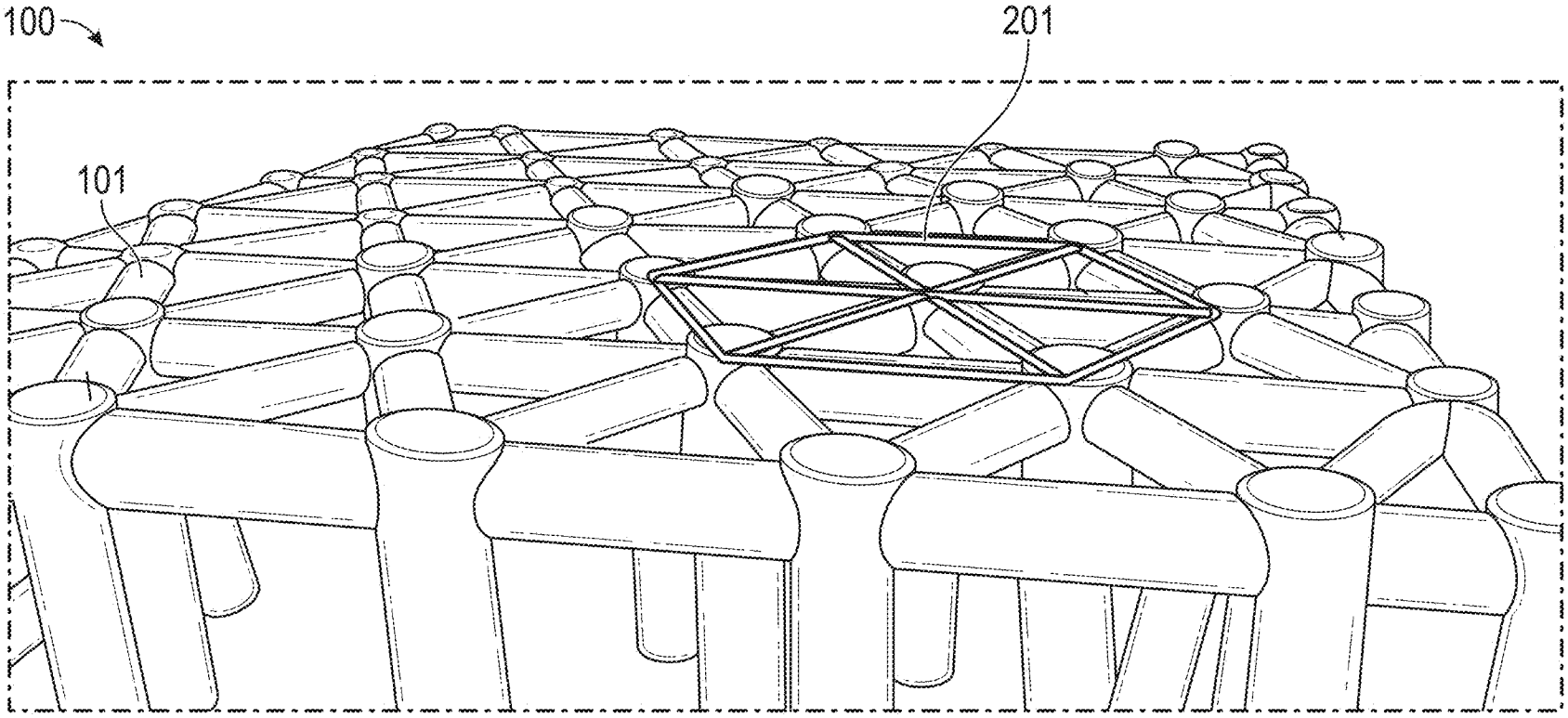

FIG. 1 illustrates an embodiment of inflatable structure 100 that includes a roof structure 101 comprising inflatable beams arranged to form a triangular or a hexagonal pattern 201 (see FIGS. 2 and 3). For example, as shown, inflatable beams can be arranged in triangular patterns formed from three inflatable beams. Six adjacently placed triangular patterns can together form a hexagonal pattern. In some embodiments, the roof structure 101 is supported by inflatable columns 102. For example, inflatable columns 102 can be positioned at the vertices of the triangular or hexagonal patterns. As will be discussed below, these supporting inflatable columns can be selectively deflated and retracted into the roof structure 101. In some instances, wall structures can be connected between these supporting inflatable beams 102 in order to create internal walls within the inflatable structure 100. By selectively retracting some of the supporting inflatable beams 102 and selectively placing walls between the supporting inflatable beams 102, various configurations for the inflatable structure 100 can be provided.

In some embodiments, the inflatable structure 100 can be variously configured for a wide number of different purposes, including as a maze, arena (e.g., for jelly ball, paintball, or other games), an escape room, a race course, a discovery center or school, as well as many others. In some embodiments, the inflatable columns 102 are pillars. In some embodiments, the configuration of the inflatable structure 100 can be quickly and easily altered by retracting one or more of the inflatable columns 102. In some embodiments, the inflatable beams of the roof structure 101 allow the overall inflatable structure 100 to remain stable, even while one or more of the inflatable support columns 102 are retracted. In some embodiments, by retracting different combinations of the inflatable support columns 102, different interior configurations can be achieved. In some embodiments, the inflatable structure 100 is portable. In some embodiments, the inflatable structure 100 includes a base 103 that may comprise a plurality of inflatable beams that support the inflatable columns 102 and/or the roof structure 101. In some embodiments, the base 103 comprises beams connecting the bottoms of the inflatable columns 102 together. In some embodiments, the inflatable beams that comprise base 103 only connect the bottoms of the inflatable columns 102 closer to the corners of the inflatable structure 100. In some embodiments, walls 901, such as panels, skins, or wraps, can be connected between the inflatable support columns that are not retracted to further customize the interior space. In some embodiments, the inflatable structure 100 may include integrated virtual reality components, including a virtual reality headset supported by the structure.

FIGS. 2 and 3 illustrate the inflatable beams forming triangular or hexagonal patterns 201 of the roof structure 101 in greater detail. In some embodiments, the roof structure 101 is made of a plurality of inflatable beams that are arranged in triangular shapes, the triangular shapes are further arranged to form hexagonal shapes 201 as shown. In some embodiments, the support columns 102 extend downward from the vertices of the triangles and/or hexagons 201 to support the roof structure 101.

Figure 4:
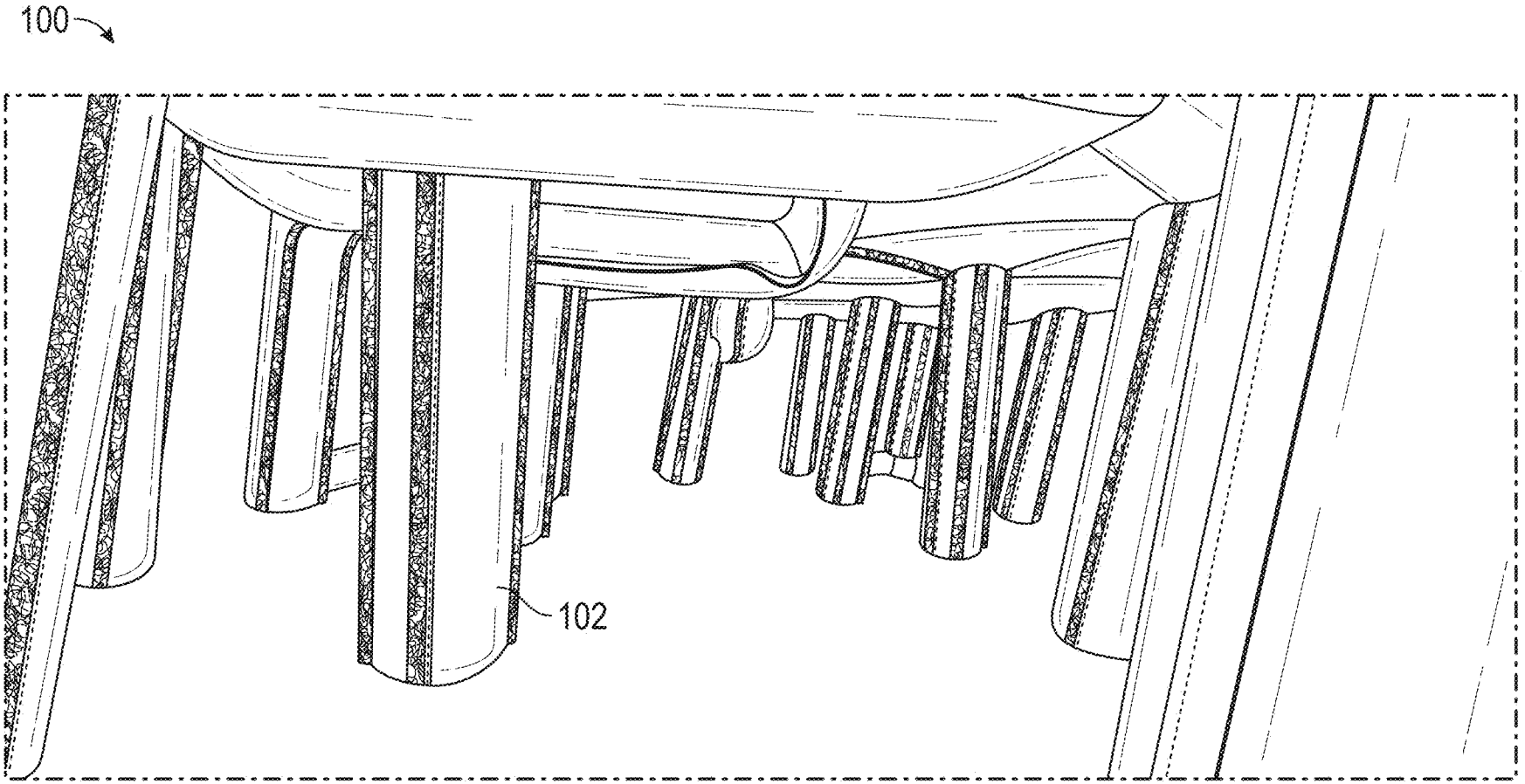
FIG. 4 illustrates an embodiment of the inflatable columns that support the roof structure.

FIG. 4 illustrates the inflatable support columns 102 that support the roof structure 101. In some embodiments, the support columns extend downward from the vertices of the triangles and/or hexagons 201 to support the roof structure.

Figure 5:
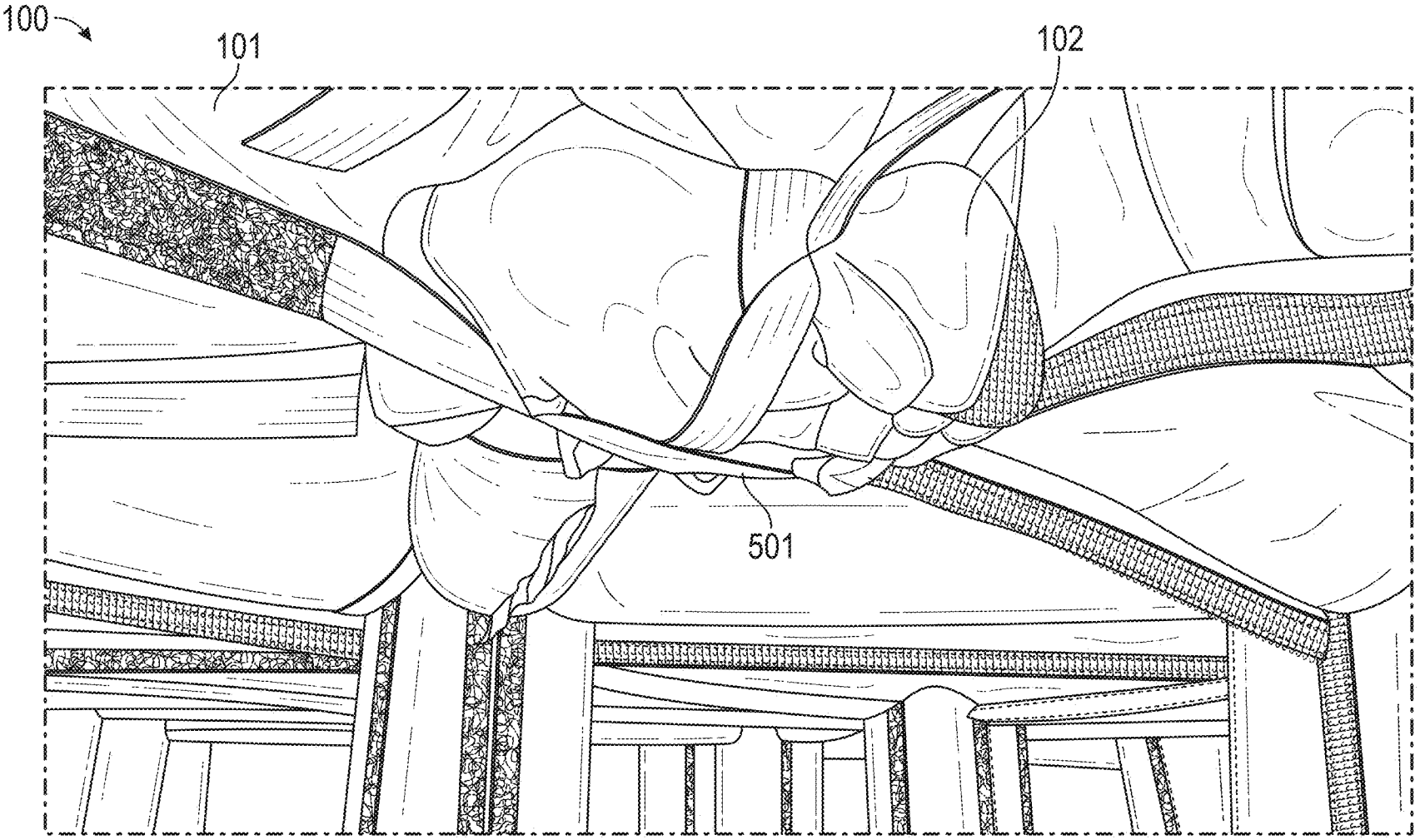
FIG. 5 illustrates an embodiment of an inflatable column that is retracted into the roof structure.
Figure 6A:
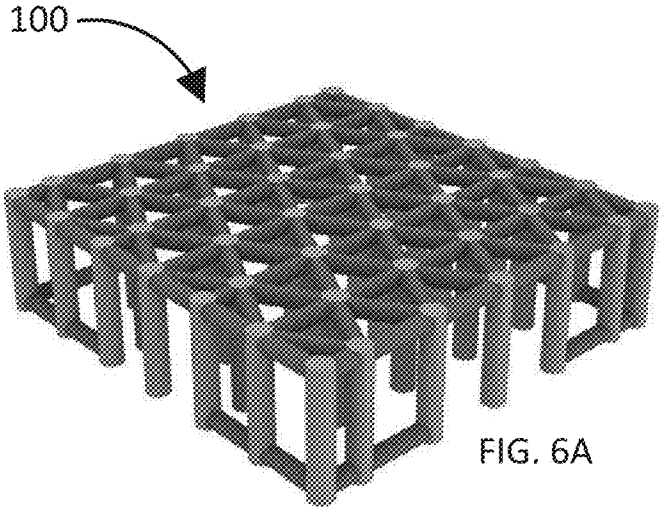
Figure 6B:
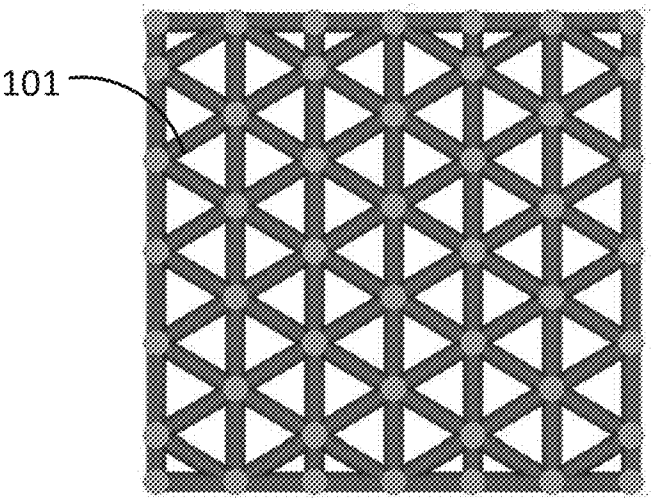
Figure 6C:
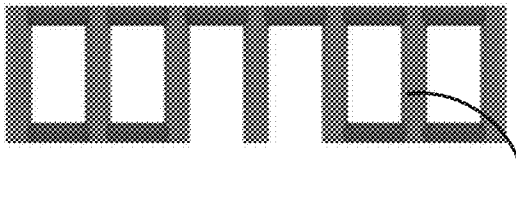
Figure 6D:
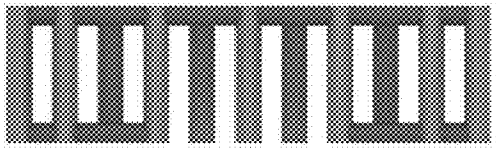
Figure 7A:
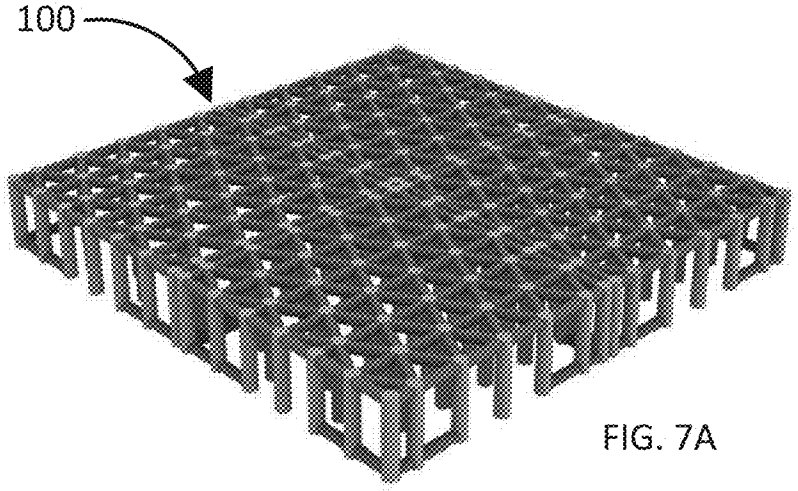
Figure 7B:
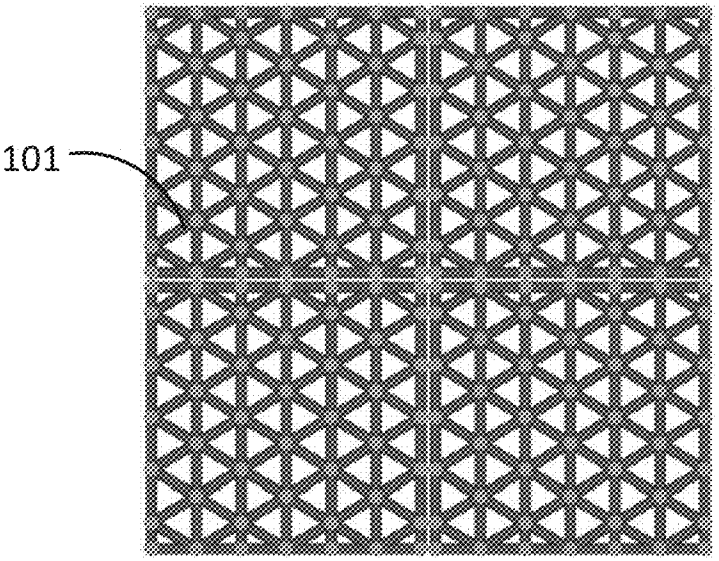
Figure 7D:
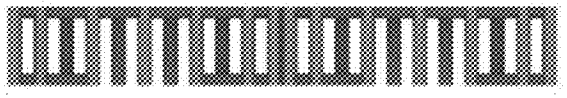
Figure 7C:
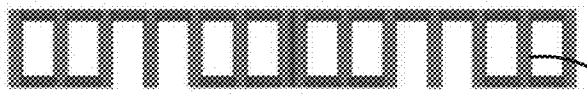
Figure 8A:
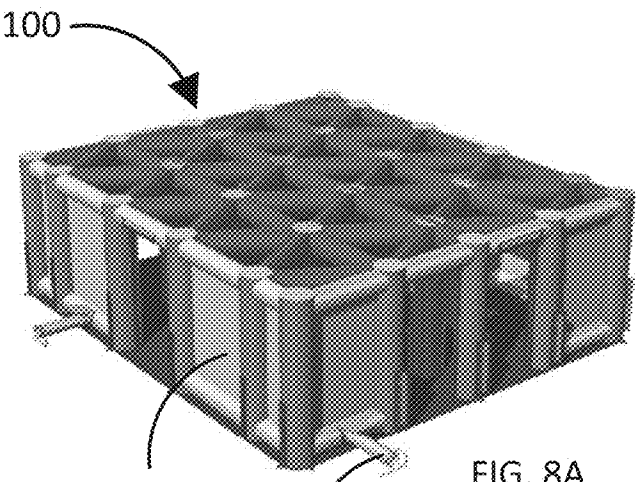
Figure 8D:
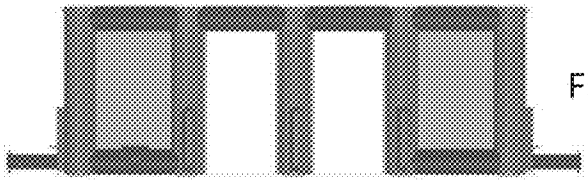
Figure 8B:
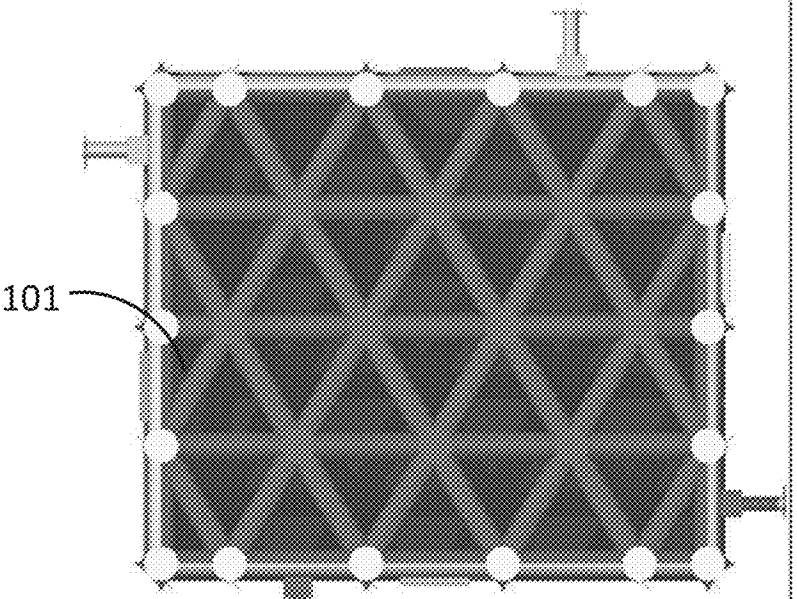
Figure 8C:
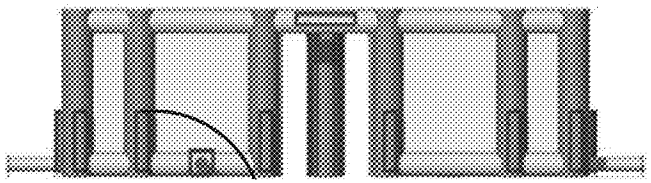
Figure 9A:
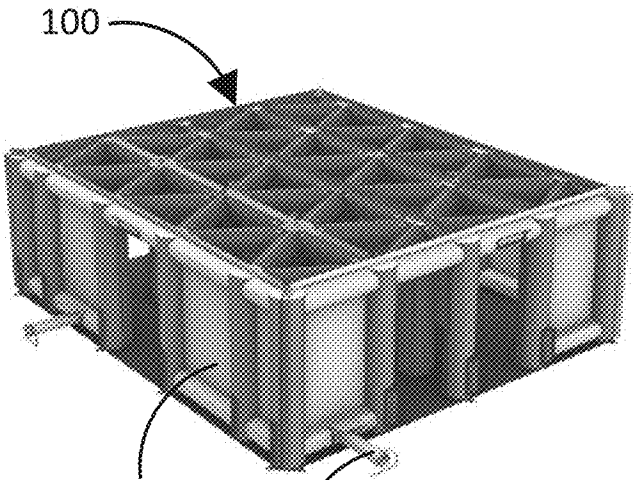
Figure 9B:
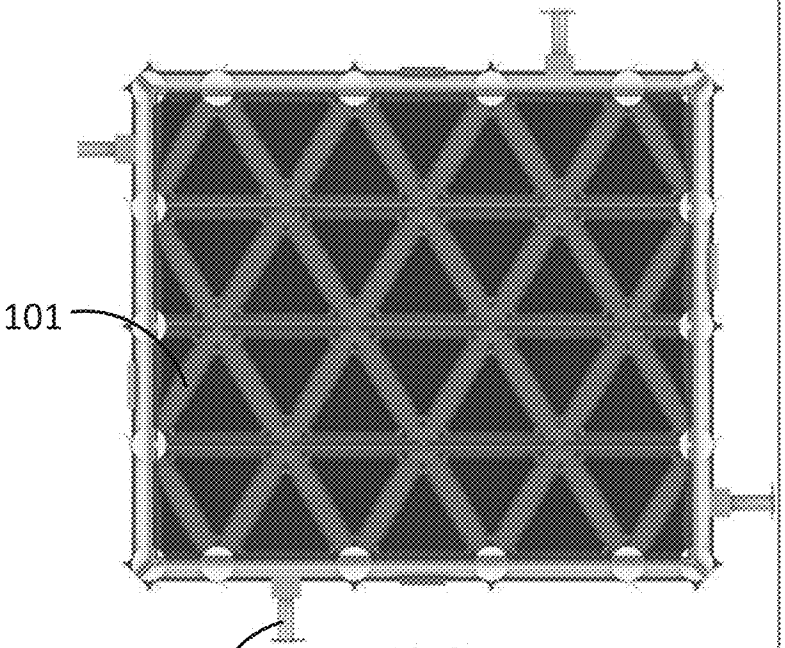
Figure 9C:
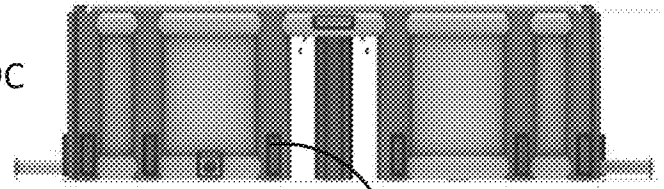
Figure 9D:
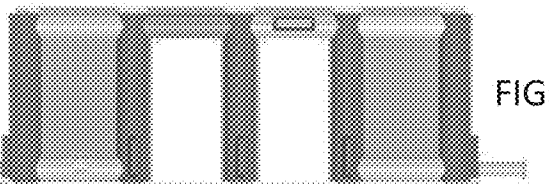
Figure 10:
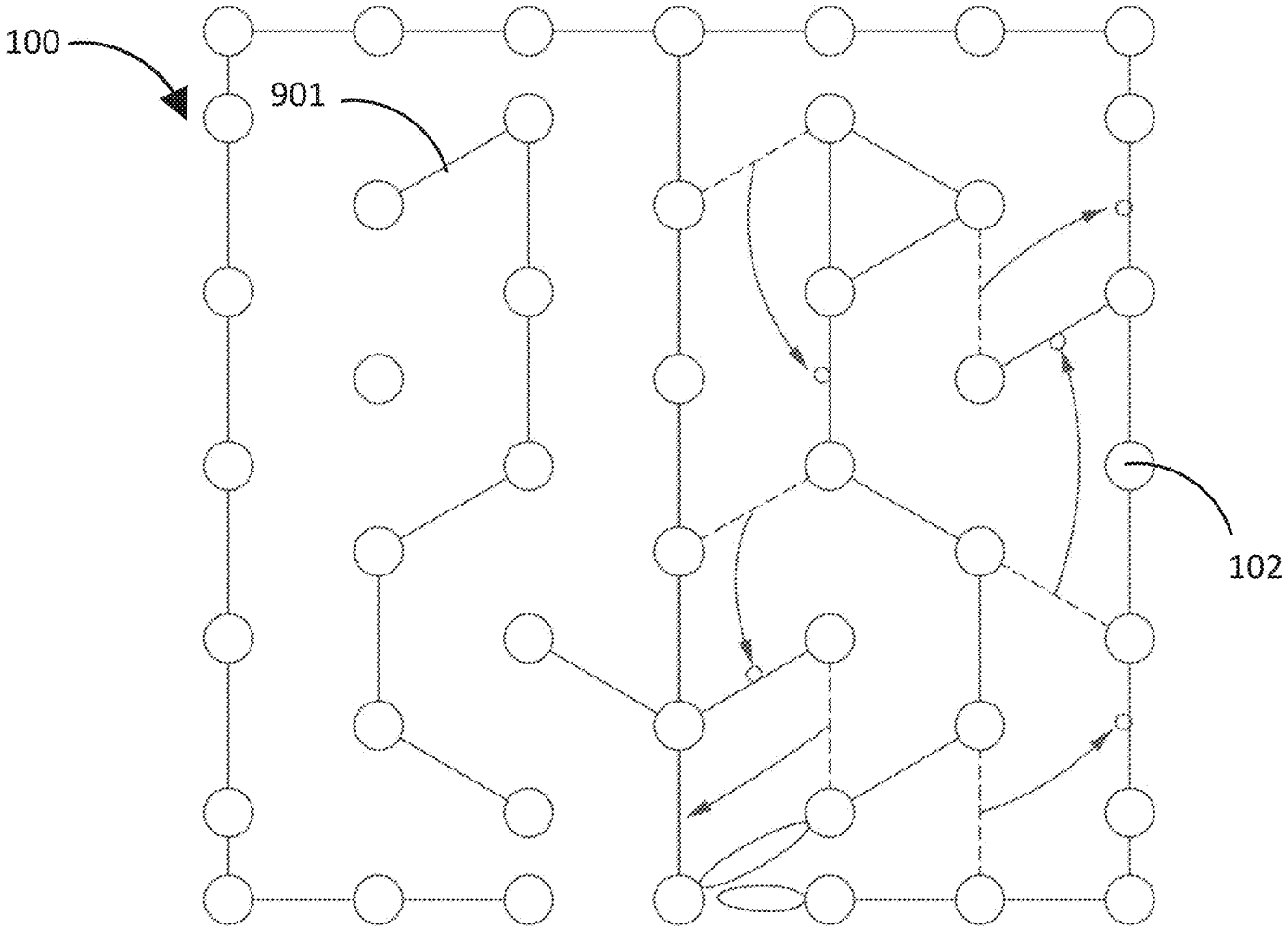
FIGS. 10, 11, 12, and 13 illustrate embodiments of mazes generated by retracting certain inflatable columns and putting walls between certain non-retracted inflatable columns.
Figure 11:
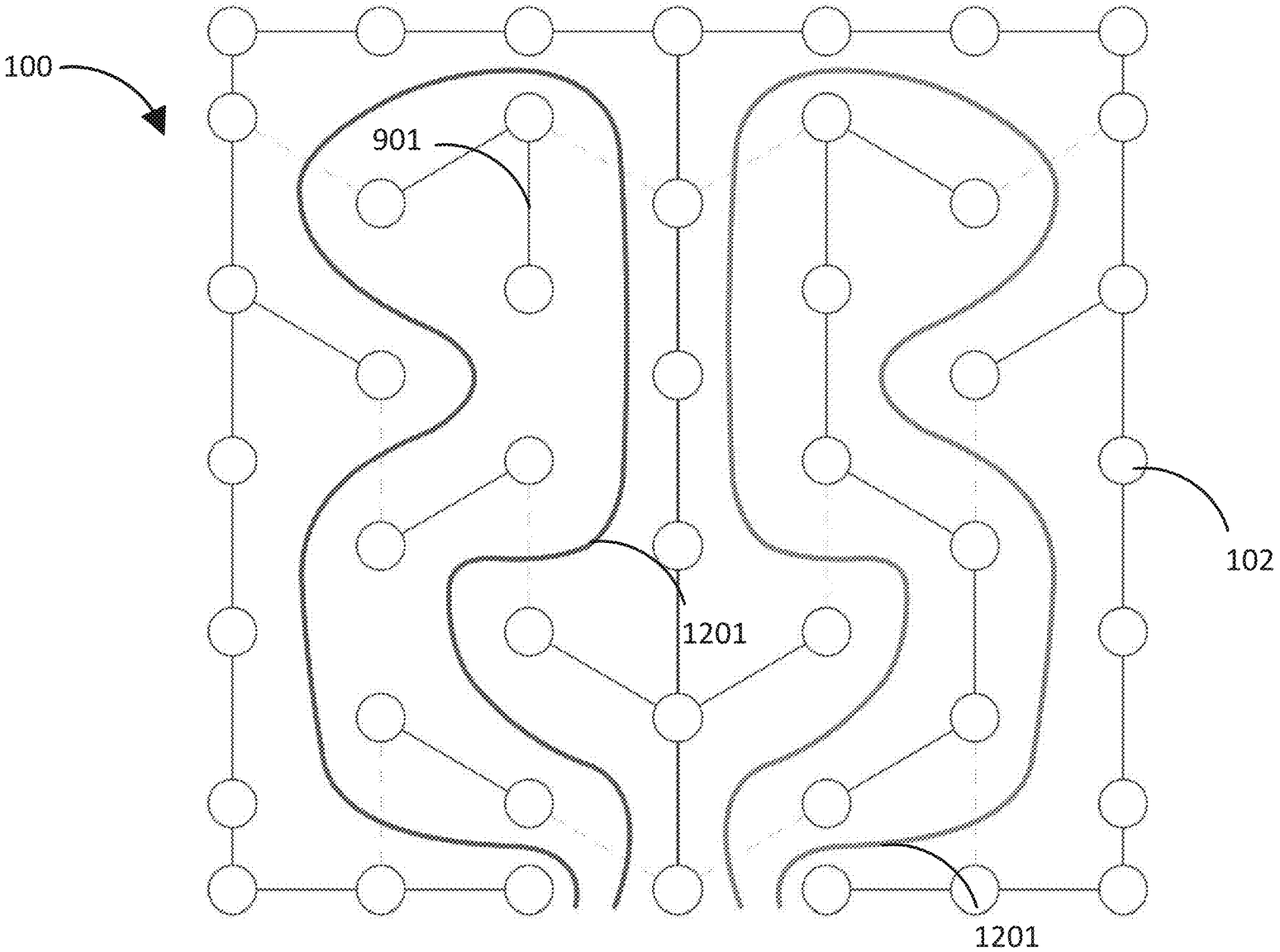
Figure 12:
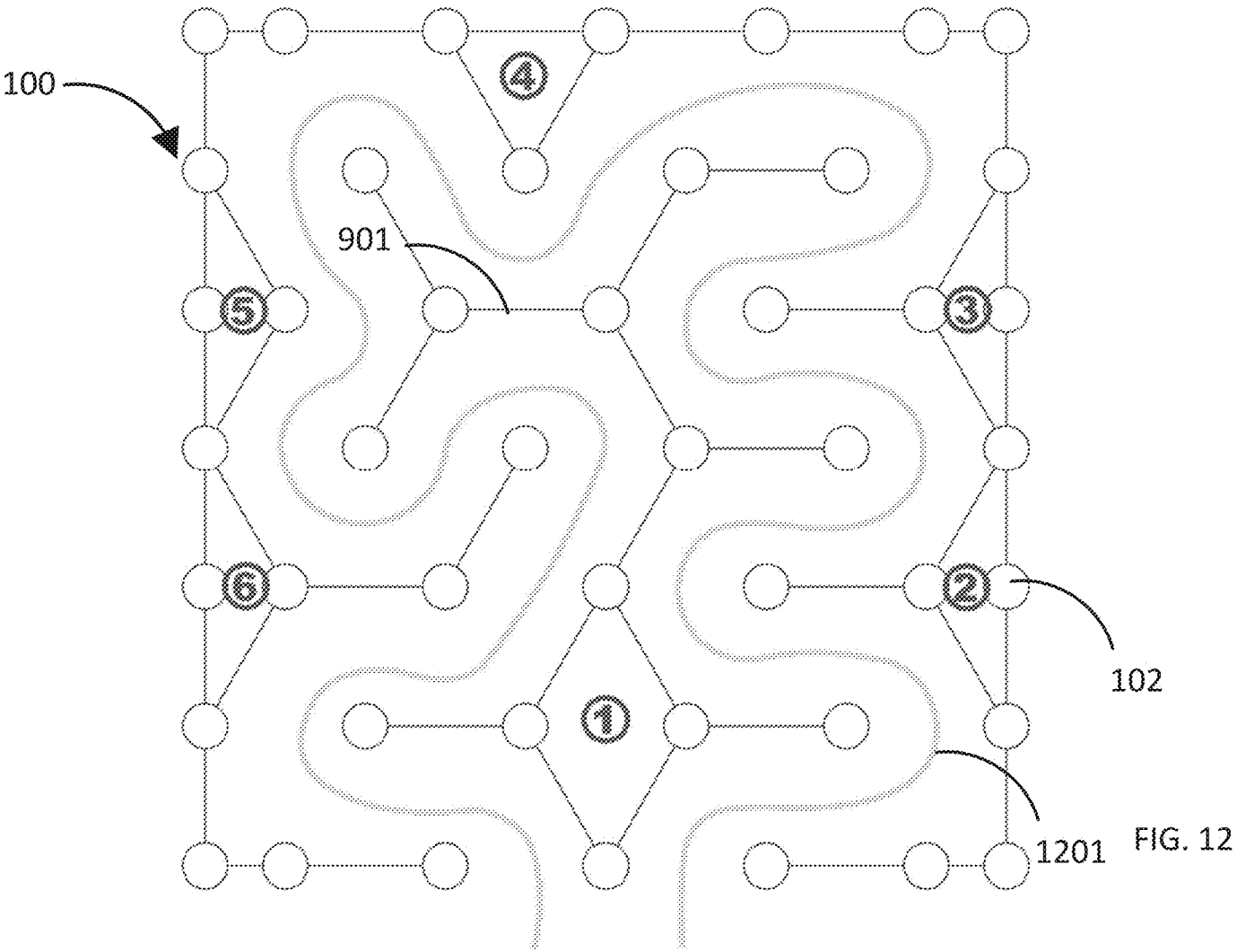
Figure 13:
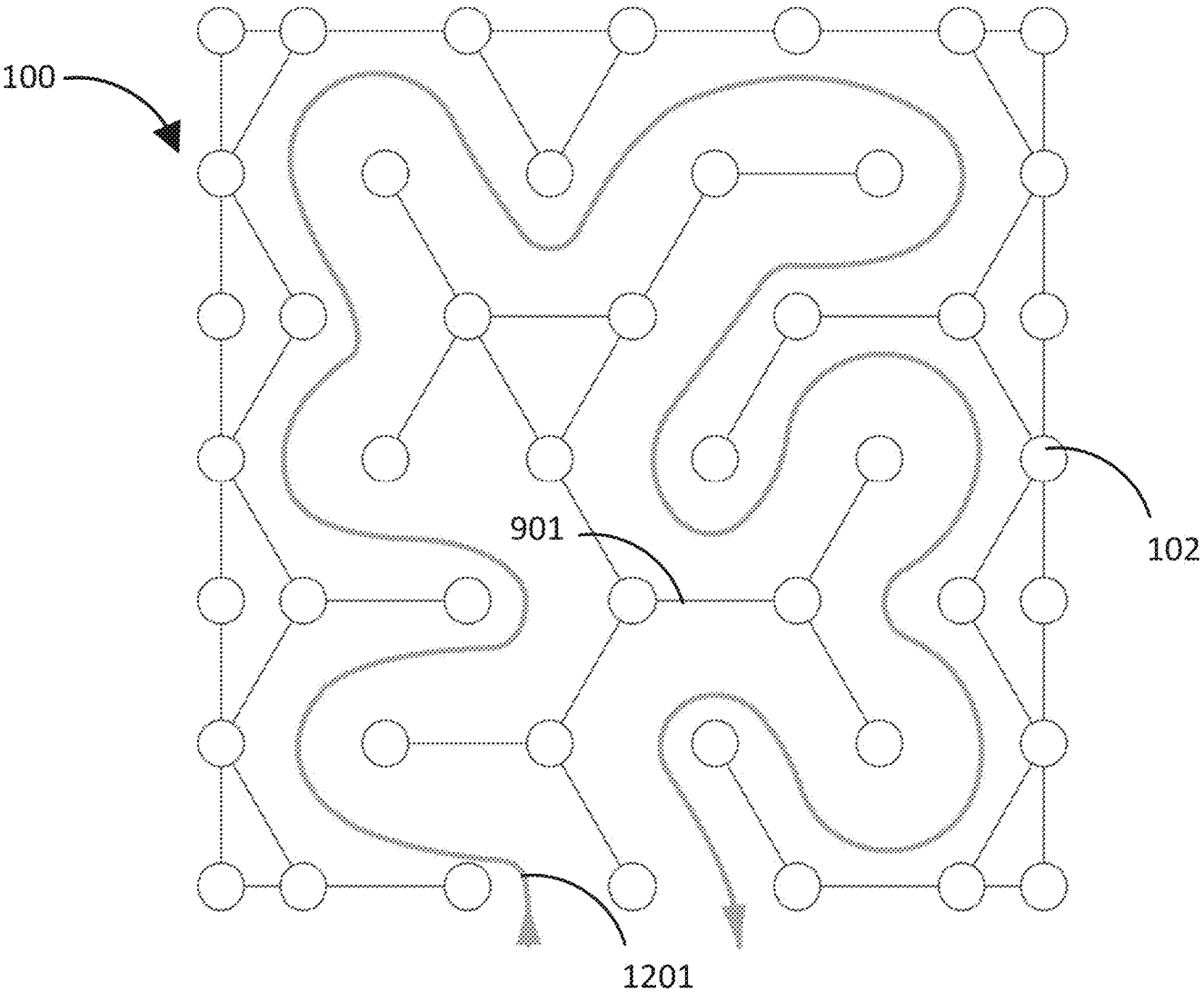

FIG. 5 illustrates that one or more of the inflatable support columns 102 can be retractable. In some embodiments, one or more of the inflatable support columns 102 can be deflated and retracted up into the roof structure 101. In some embodiments, the retracted support column 102 can be secured to the underside of the roof structure 101 by straps 501. In some embodiments, the straps 501 include Velcro. In some embodiments, the straps 501 include nylon. In some embodiments, the straps 501 include rope. In some embodiments, the straps 501 are removable from the roof structure 101. In some embodiments, the straps 501 are permanently fixed to the roof structure 101. Retracting the support columns 102 allows for customization of the interior space of the inflatable structure 100. In some embodiments, walls 901, such as panels, skins, or wraps, can be connected between the inflatable support columns that are not retracted to further customize the interior space. In some embodiments, walls 901 can be arranged between the non-retracted support columns 102 to configure the inflatable structure 100 as a maze, arena, escape room, race course, discovery center or school, or other configurations. In some embodiments, the vertices of the roof structure 101 includes a recess into which the support columns 102 can be retracted. In some embodiments, the support columns 102 are inflated separately from other components of the inflatable structure 100 such that they can be deflated without deflating the rest of the inflatable structure 100. In some embodiments, valves or other seals are positioned between the bladder or inflatable portion of the support beams 102 such that the support columns can be inflated together with the rest of the inflatable structure 100 (e.g., with the valves open) and deflated separately (e.g., with the valves closed).

FIGS. 6A-6D illustrate an embodiment of the inflatable structure 100 with dimensions for the example embodiment. These dimensions are provided by way of example and are not limiting as other sizes are possible. In some embodiments, the inflatable structure 100 includes approximately 2 inflatable columns 102. In some embodiments, the inflatable structure 100 includes approximately 6 inflatable columns 102. In some embodiments, the inflatable structure 100 includes approximately 10 inflatable columns 102. In some embodiments, the inflatable structure 100 includes approximately 14 inflatable columns 102. In some embodiments, the inflatable structure 100 includes approximately 18 inflatable columns 102. In some embodiments, the inflatable structure 100 includes approximately 22 inflatable columns 102. In some embodiments, the inflatable structure 100 includes approximately 26 inflatable columns 102. In some embodiments, the inflatable structure 100 includes approximately 30 inflatable columns 102. In some embodiments, the inflatable structure 100 includes approximately 34 inflatable columns 102. In some embodiments, the inflatable structure 100 includes approximately 38 inflatable columns 102. In some embodiments, the inflatable structure 100 includes approximately 42 inflatable columns 102. In the illustrated embodiment, the inflatable structure 100 includes approximately 46 inflatable columns 102. In some embodiments, the inflatable structure 100 includes approximately 50 inflatable columns 102. In some embodiments, the inflatable structure 100 includes more than 50 inflatable columns 102.

In some embodiments, the inflatable structure 100 is approximately 3 feet tall. In some embodiments, the inflatable structure 100 is approximately 4 feet tall. In some embodiments, the inflatable structure 100 is approximately 5 feet tall. In some embodiments, the inflatable structure 100 is approximately 6 feet tall. In some embodiments, the inflatable structure 100 is approximately 7 feet tall. In some embodiments, the inflatable structure is approximately 8 feet tall. In some embodiments, the inflatable structure 100 is approximately 9 feet tall. In some embodiments, the inflatable structure 100 is approximately 10 feet tall. In some embodiments, the inflatable structure 100 is more than 10 feet tall.

In some embodiments, the inflatable structure 100 is approximately 5 feet wide. In some embodiments, the inflatable structure 100 is approximately 10 feet wide. In some embodiments, the inflatable structure 100 is approximately 15 feet wide. In some embodiments, the inflatable structure 100 is approximately 20 feet wide. In some embodiments, the inflatable structure 100 is approximately 25 feet wide. In some embodiments, the inflatable structure 100 is approximately 26 feet wide. In some embodiments, the inflatable structure 100 is approximately 27 feet wide. In some embodiments, the inflatable structure 100 is approximately 28 feet wide. In a preferred embodiment, the inflatable structure 100 is approximately 29 feet wide. In some embodiments, the inflatable structure 100 is approximately 30 feet wide. In some embodiments, the inflatable structure 100 is approximately 35 feet wide. In some embodiments, the inflatable structure 100 is approximately 40 feet wide. In some embodiments, the inflatable structure 100 is approximately 45 feet wide. In some embodiments, the inflatable structure 100 is approximately 50 feet wide. In some embodiments, the inflatable structure 100 is more than 50 feet wide.

FIG. 7 illustrates an embodiment of four inflatable structures 100 placed adjacently with dimensions for the example embodiment. In some embodiments, a plurality of inflatable structures 100 can be placed beside each other to simulate one larger inflatable structure. In some embodiments, this can allow for the creation of more complicated mazes and patterns within the inflatable structures 100.

FIGS. 8 and 9 illustrate embodiments of the inflatable structure 100 with walls 901 connected between the inflatable columns. In some embodiments, the walls 901, such as panels, skins, or wraps, can be connected between the inflatable support columns that are not retracted to further customize the interior space. The inflatable walls can comprise sheets which can be attached to the columns with Velcro, ties or the like.

In some embodiments, as illustrated in FIGS. 8 and 9, the inflatable structure 100 has air inlets 902 that can be connected to an air source to inflate the inflatable structure 100. In some embodiments, the air source is an air pump. In some embodiments, the air source is an electric inflater. In some embodiments, the panels of the walls 901 may comprise various materials including rubber, plastic, vinyl, nylon, PVC, etc. In some embodiments, the walls 901 may be inflatable. In some embodiments, the walls 901 may be retractable. In some embodiments, the walls 901 may be clear. In some embodiments, the walls 901 may be mirrored. In some embodiments, the walls 901 may be opaque. In some embodiments, the walls 901 may be covered with skins to create a theme for the inflatable structure 100. In some embodiments, the walls 901 may be able to be pushed down. In some embodiments, the walls 901 may be stable. In some embodiments, the walls 901 may be fixed to the roof structure 101. In some embodiments, the walls 901 may be fixed to the inflatable columns 102. In some embodiments, the walls 901 may be fixed to the base structure 103.

FIGS. 10, 11, 12, and 13 illustrate embodiments of mazes generated by retracting certain inflatable columns 102 and putting walls 901 between certain non-retracted inflatable columns 102. In some embodiments, children or adults can move through the inflatable structure 100 in a path 1201. In some embodiments, there are multiple paths 1201 through the inflatable structure 100. In some embodiments, the path 1201 through the inflatable structure 100 can be altered by retracting or unretracting columns 102. In some embodiments, the path 1201 through the inflatable structure 100 can be altered by adding or removing walls 901.

In some embodiments, the hexagonal roof structure 101 provides supports such that at least three inflatable support columns 102 in a row can be retracted without causing the roof 101 to sag. In some embodiments, his can create an inflatable structure 100 that is capable of large interior clear spans.

In some embodiments, each section of the inflatable structure 100 is pneumatically connected such that the entire inflatable structure 100 can be inflated and deflated at once, for example, by connecting an air source to an air inlet 902 of the structure. In an alternative embodiment, each section can be separately inflated and then assembled together to form the inflatable structure 100.

The inflatable structure may comprise inflatable columns 102 that can provide the structural support for the inflatable structure 100. For example, in some embodiments, no additional framing is required to support the inflatable structure 100 beyond inflating the inflatable columns 102. In some embodiments, inflatable columns 102 can be configured so as to be fillable with a gas, such as air. In some embodiments, the inflatable columns 102 can include air inlets 902 that can be connected to air sources to inflate the columns 102.

In some embodiments, the panels of the inflatable walls 901 may comprise various materials including rubber, plastic, vinyl, nylon, PVC, etc. In some embodiments, seams of panels may be sewn, glued, or welded together, or otherwise attached to form the walls 901. In some embodiments, the seams can be substantially airtight. In some embodiments, parts of the inflatable structure 100 may be integrally formed, reducing the need for seams. In some embodiments, parts of the inflatable structure 100 may comprise metal or plastics, such as any tie downs, connectors, etc.

In some embodiments, portions of the inflatable structure 100 may comprise eyelets, tabs, or tie downs (not shown) that can accept a rope, strap, or other devices that may help by keeping the inflatable structure from moving. In some embodiments, one end of a rope may be tied or attached to a tie down, with the other end of the rope being secured to a stable structure. In some embodiments, the rope and tie down may prevent or discourage the inflatable structure 100 from moving laterally or vertically, twisting, or otherwise being displaced. In some embodiments, the tie downs may help prevent movement of the inflatable structure 100 against the force of wind.

In some embodiments, the inflatable columns 102 may be configured with hook and loop fasteners or other connection mechanisms that allow the walls 901 to be covered with themed elements. In some embodiments, this can allow for attachment of themed panels that match the virtual reality games played therein. In some embodiments, this allows the inflatable structure 100 to be quickly and easily re-themed if desired. In some embodiments, the themed elements can be positioned on the interior and/or exterior of the inflatable structure 100. In some embodiments, the interior of the inflatable structure 100 can be configured as a green-screen such that a video of a user playing the game can be superimposed on the virtual reality world for display. In some embodiments, this can allow spectators to view the user in the virtual reality world.

In some embodiments, the inflatable columns 102 are pneumatically connected such that all of the inflatable walls 901 can be inflated at once. This can simplify installation or set up of the inflatable structure 100. In some embodiments, to set up the inflatable structure 100, one may simply connect an air inlet 902 to an air source, such as a pump to inflate the inflatable structure 100. In some embodiments, after inflation, the inflatable structure 100 may be tied down to the ground as noted above.

In some embodiments, users suitable for using the inflatable structure 100 may be children, adults, families, etc. In some embodiments, the inflatable structure 100 may be used in a variety of events and contexts. In some embodiments, the inflatable structure 100 may be assembled and utilized at carnivals, fairs, parties, corporate events, amusement parks, etc. Reasons for using the inflatable structure may vary, and may include personal enjoyment, competitions, or other reasons.

In some embodiments, after users have finished using the inflatable structure 100 and the owner or operator wishes to disassemble the inflatable structure 100, the inflatable structure 100 may generally be deflated. In some embodiments, the deflated inflatable structure 100 may then be stored or transported easily.

In some embodiments, a ground layer may cover at least part of the ground or other surrounding area near the inflatable structure 100. In some embodiments, the ground layer may be placed on the ground and be disposed between the ground and the inflatable structure 100 or integrally formed with the bottom surfaces or base 103 of the inflatable structure. In some embodiments, the ground layer may comprise various materials including rubber, plastic, vinyl, nylon, PVC, etc. In some embodiments, parts of the ground layer may comprise metal or plastics, such as any tie downs or connectors. In some embodiments, the ground layer may be configured to serve various functions. In some embodiments, the ground layer may be configured to provide a protective covering over the ground, preventing the ground around the inflatable structure 100 from getting damaged by people walking near the inflatable structure 100. In some embodiments, the ground layer may protect at least part of the inflatable structure 100 from becoming damaged due to objects located on the ground or the ground itself. For instance, in some embodiments, the ground may contain sharp objects like glass or nails, or more natural objects like rocks that could cause harm to the inflatable structure 100. In some embodiments, a ground layer may help prevent these or other objects from damaging the inflatable structure 100.

Additionally, in some embodiments, some parts of the inflatable structure 100 derive at least part of their vertical and lateral stability from being inflated. In some embodiments, since the inflatable segments are configured in specific shapes, once they are filled with air, they may exhibit structural properties that allow them to remain upright. In some embodiments, some inflatable segments require few or no additional supports. In contrast to the inflatable structure 100, other structures often require substantial vertical supports. Instead of trapped air for vertical support, traditional structures often use heavy metal scaffolding or heavy wooden structures. In some embodiments, by using trapped air to vertically support parts of the inflatable structure 100, the inflatable structure 100 may be lighter overall given the decrease in the amount of vertical support needed.

In some embodiments, not all parts of the inflatable structure 100 need to be inflatable in order to derive benefit from the inflatable portions. Other advantages of the inflatable structure comprising some inflatable portions may exist. Additional features of the inflatable structure, which may be present in some embodiments, are shown and described with reference to the remaining figures.

A person having ordinary skill in the art will readily appreciate, the directional terms are sometimes used for ease of describing the figures and indicate relative positions corresponding to the orientation of the figure on a properly oriented page, and may not reflect the proper orientation of the device as implemented.

Certain features that are described in this specification in the context of separate implementations also can be implemented in combination in a single implementation. Conversely, various features that are described in the context of a single implementation also can be implemented in multiple implementations separately or in any suitable sub combination. Moreover, although features may be described above as acting in certain combinations and even initially claimed as such, one or more features from a claimed combination can in some cases be excised from the combination, and the claimed combination may be directed to a sub combination or variation of a sub combination.

The singular forms "a," "an," and "the" include plural referents unless the context clearly dictates otherwise. Thus, for example, reference to an item includes reference to one or more items. The term "ones" refers to one, two, or more, and generally applies to the selection of some or all of a quantity. The term "plurality" refers to two or more of an item. The term "about" means quantities, dimensions, sizes, formulations, parameters, shapes and other characteristics need not be exact, but may be approximated and/or larger or smaller, as desired, reflecting acceptable tolerances, conversion factors, rounding off, measurement error and the like and other factors known to those of skill in the art. The term "substantially" means that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

Numerical data may be expressed or presented herein in a range format. It is to be understood that such a range format is used merely for convenience and brevity and thus should be interpreted flexibly to include not only the numerical values explicitly recited as the limits of the range, but also interpreted to include all of the individual numerical values or sub-ranges encompassed within that range as if each numerical value and sub-range is explicitly recited. As an illustration, a numerical range of "about 1 to 5" should be interpreted to include not only the explicitly recited values of about 1 to about 5, but also include individual values and sub-ranges within the indicated range. Thus, included in this numerical range are individual values such as 2, 3 and 4 and sub-ranges such as 1-3, 2-4 and 3-5, etc. This same principle applies to ranges reciting only one numerical value (e.g., "greater than about 1") and should apply regardless of the breadth of the range or the characteristics being described.

A plurality of items may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. Furthermore, where the terms "and" and "or" are used in conjunction with a list of items, they are to be interpreted broadly, in that any one or more of the listed items may be used alone or in combination with other listed items. The term "alternatively" refers to selection of one of two or more alternatives, and is not intended to limit the selection to only those listed alternatives or to only one of the listed alternatives at a time, unless the context clearly indicates otherwise.

It should be noted that various changes and modifications to the presently preferred embodiments described herein will be apparent to those skilled in the art. Such changes and modifications may be made without departing from the spirit and scope of the invention and without diminishing its attendant advantages. For instance, various components may be repositioned as desired. It is therefore intended that such changes and modifications be included within the scope of the invention. Moreover, not all of the features, aspects and advantages are necessarily required to practice the present invention.

What is claimed is:

1. An inflatable structure comprising:

an roof structure comprising a plurality of inflatable beams arranged to form:

a rectangular perimeter, and an interior structure comprising a plurality of triangles, wherein the plurality of inflatable beams are pneumatically connected; and inflatable columns that support the roof structure, wherein the inflatable columns comprise:

exterior inflatable columns pneumatically connected to the inflatable beams of the rectangular perimeter of the roof structure, and interior inflatable columns pneumatically connected to the inflatable beams of the interior structure of the roof structure, wherein each of the interior inflatable columns is positioned at a vertex of one of the plurality of triangles of the interior structure of the roof structure, and wherein each of the interior inflatable columns is configured such that the interior inflatable column can be selectively deflated, and when deflated, the interior inflatable column can be retracted into the vertex of the triangle of the interior structure of the roof structure.

2. The inflatable structure of claim 1, further comprising: a base structure comprising inflatable beams that support the one or more inflatable columns.

3. The inflatable structure of claim 1, further comprising: a ground structure comprising a layer between the inflatable columns and a ground.

4. The inflatable structure of claim 1, further comprising: tabs configured to accept a rope to prevent the inflatable structure from moving.

5. The inflatable structure of claim 1, further comprising: an air inlet configured to receive air to inflate the inflatable structure.

6. The inflatable structure of claim 1, wherein the roof structure comprises a plurality of inflatable beams forming a hexagonal pattern.

7. The inflatable structure of claim 1, further comprising: one or more walls configured to be connected between the inflatable columns, wherein the one or more walls can be removed when the inflatable columns are retracted.

8. The inflatable structure of claim 7, wherein the one or more walls are inflatable.

9. The inflatable structure of claim 7, further comprising one or more themed skins configured to be installed over the one or more walls to change how the one or more walls appear.

10. The inflatable structure of claim 1, wherein a first inflatable structure is configured to connect with a second inflatable structure to create a larger inflatable structure.

* * * * *